United States Patent [19]

Kaluzhsky et al.

[11] 4,211,626

[45] Jul. 8, 1980

[54] DUAL CURRENT SUPPLY SYSTEM FOR ALUMINUM-PRODUCING ELECTROLYZERS

[76] Inventors: Nikolai A. Kaluzhsky, Sredny prospekt, 6, kv. 23; Ilya G. Kil, ulitsa Gavanskaya, 37, kv. 61; Vladimir P. Nikiforov, ulitsa Nalichnaya, 49, kv. 8; Vasily I. Nosikov, Moskovsky prospekt, 205, kv. 455; Alexandr N. Smorodinov, ulitsa Bukharestskaya, 31, korpus 3, kv. 55; Mikhail V. Yazev, Kirovksy prospekt, 42b, kv. 65; Igor K. Tsybukov, Tikhoretsky prospekt, 9, korpus 10, kv. 54, all of Leningrad, U.S.S.R.

[21] Appl. No.: 913,328

[22] Filed: Jun. 7, 1978

[51] Int. Cl.[2] ..... C25C 3/16

[52] U.S. Cl. ..... 204/243 M; 204/244

[58] Field of Search ..... 204/243 R–247, 204/67, 228

[56] References Cited

U.S. PATENT DOCUMENTS

| | | | |
|---|---|---|---|
| 3,756,938 | 9/1973 | Nebell | 204/243 M |
| 3,775,280 | 11/1973 | Nikiforov et al. | 204/243 M |
| 3,775,281 | 11/1973 | Schmidt-Hatting | 204/243 M |
| 4,049,528 | 9/1977 | Morel et al. | 204/243 M |

*Primary Examiner*—Howard S. Williams
*Assistant Examiner*—D. R. Valentine
*Attorney, Agent, or Firm*—Steinberg and Blake

[57] ABSTRACT

A dual current supply system for aluminum-producing electrolyzers longitudinally arranged in a series-connected row comprises at least four anode risers in each space between next-adjacent electrolyzers. The system includes anode systems and anode buses electrically connected to the anode risers for supplying current from the anode risers to the anode systems. Two of the anode risers of one of a pair of next-adjacent electrolyzers are coaxially positioned in the space between the next-adjacent electrolyzers and two of the anode risers of the other of the pair of next-adjacent electrolyzers are positioned in the space between the next-adjacent electrolyzers in coplanar relation with the anode risers of the one of the next-adjacent electrolyzers. The arrangement of the anode risers enables a more uniform distribution of the magnetic field and permits the total length of the electrolyzer body and current supply buses to be reduced.

4 Claims, 1 Drawing Figure

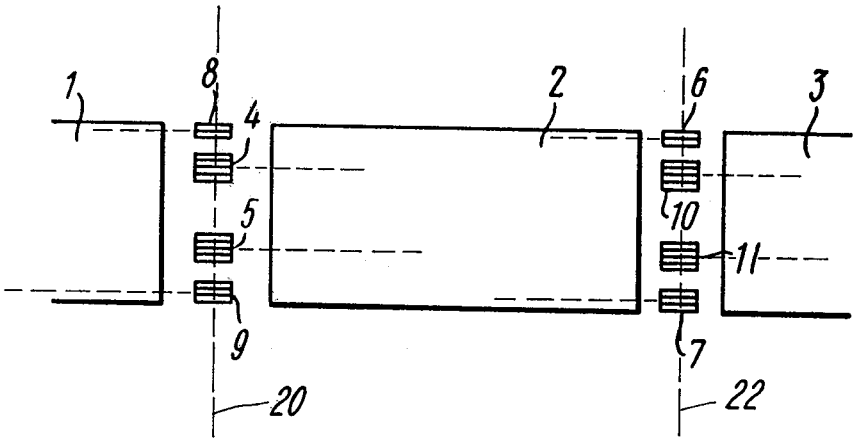
1
8
4
5
9
20
2
6
10
11
7
22
3

DUAL CURRENT SUPPLY SYSTEM FOR ALUMINUM-PRODUCING ELECTROLYZERS

The present invention relates to a system of current supply for aluminum-producing electrolyzers, and more particularly to an arrangement of anode assemblies providing two-sided supply of electric current to next-adjacent electrolyzers disposed longitudinally in a row.

When the electrolyzers are operated at currents equal to or more than 100,000 A, appreciable electromagnetic forces occur which bring about surface bending of the liquid cathode metal and its intensive circulation.

The magnitude and direction of these adverse effects of electromagnetic forces is largely dependent on the arrangement of the current supply system, and, more particularly, on the anode risers.

Magnetic field studies recently carried out both on pilot and production electrolyzers designed for large currents have made it possible to set forth requirements for an aluminum-producing electrolyzer current supply system, as follows:

$$B_y(0)=0;\ \delta B_y/\delta x=\delta B_x/\delta y\rightarrow 0;\ \delta B_z/\delta x=\delta B_x/\delta y\rightarrow 0;$$

where $B_y$ is the transverse component of the magnetic field, $B_x$ is the longitudinal component of the magnetic field, $B_z$ is the vertical component of the magnetic field.

In other words, the aforementioned requirements boil down to the symmetry of the transverse magnetic field, the invariability of the values $B_y$ and $B_x$ along the electrolyzer axes, and the minimum value of absolute magnitude $B_z$ operative in the corners of the electrolyzer, as well as the symmetry of the vertical magnetic field with respect to the electrolyzer axes.

In aluminum production, it is common practice to arrange electrolyzers in parallel rows. The electrolyzers of each row are connected in series, i.e., the cathode of one electrolyzer is connected to the anode of the next-adjacent electrolyzer. Two techniques of supplying current to electrolyzers are known, including one-sided anode current supply and dual, or two sided anode current supply. In the one-sided current supply system, generally a pair of anode risers are interposed between a pair of next-adjacent electrolyzers. The anode risers are associated only with one of the electrolyzers and supply current to this electrolyzer on one side only. Such a current supply system is disclosed, for example, in the GDR Patent Specification No. 22,418. In this system, between any pair of next-adjacent electrolyzers, a pair of anode risers are arranged in the same vertical plane parallel to the electrolyzer end faces. Such a current supply arrangement, however, is not applicable to high-power electrolyzers designed for currents exceeding 100,000 A, since the normal manufacturing process of electrolysis is here disturbed on account of a marked asymmetry of the magnetic field and a high magnetic flux strength on the current supply side of the electrolyzer.

In the two-sided current supply system, it is common to position four anode risers near each of the electrolyzers, in series within a row, two assemblies being placed at either end.

The known dual current supply system for aluminum-producing electrolyzers (cf. FRG Patent No. 1,758,664) comprises a plurality of anode risers arranged in the spaces between any pair of next-adjacent electrolyzers and supplying current thereto. Thus, four anode risers are positioned between a pair of next-adjacent electrolyzers, two of said anode risers being associated with one electrolyzer and the other two of said anode risers are associated with the other electrolyzer. The axes of the anode risers of next-adjacent electrolyzers extend in two vertical planes parallel to the electrolyzer end faces, each of the planes being shifted towards a respective electrolyzer. The end faces are the substantially vertical lateral walls of the electrolyzers which face each other. Since the pairs of anode risers belonging to the front and rear ends of the adjacent electrolyzers, respectively, are differently spaced from the transverse axes of these electrolyzers with different currents flowing therethrough, the current-induced magnetic field is asymmetrical with respect to the transverse planes of the electrolyzers, i.e., the planes crossing the transverse axis of the electrolyzer and normal to the current flow. The magnetic field asymmetry results in a static, or sometimes dynamic, warping of the metal since, in such case, the field is not symmetric with respect to the center of the electrolyzer either.

Furthermore, the arrangement of anode risers in two parallel planes increases the length of the current supply buses and, consequently, the total length of the electrolyzer bodies.

It is an object of the present invention to provide a current supply system for electrolyzers with two-sided anode current supply, such as to ensure the normal manufacturing process of aluminum electrolysis at currents in excess of 100,000 A.

Another object of the invention is to minimize the adverse effects of the magnetic field on the aluminum electrolysis process.

A further object of the invention is to reduce the total length of the current supply buses and electrolyzer bodies by providing a smaller spacing between the electrolyzer end faces in a two-sided anode current supply system.

With these and other objects in view, there is provided a system for two-sided current supply to aluminum-producing electrolyzers, comprising groups of anode risers positioned in the spaces between the end faces of next-adjacent electrolyzers and supplying current thereto. In accordance with the invention, all the anode risers in each space are positioned in the same vertical plane.

The features and advantages of the present invention will become more apparent from the following detailed description with reference to the accompanying drawing, wherein the single FIGURE is a schematic view of a dual current supply system for electrolyzers, in accordance with the invention.

The drawing is a schematic representation of three electrolyzers 1, 2, 3 positioned in a row of electrolyzers connected in series, with a two-sided arrangement of current supply to the anodes. Each of the electrolyzers are entirely conventional and preferably comprise an insulated pot having a conventional carbon lining. As is known, cathodically precipitated aluminum collects on the bottom of the lined pot, the surface of the aluminum then acting as a cathode during continued electrolysis. Anode risers 4, 5, 8 and 9 are positioned between the electrolyzers 1 and 2. The anode risers 4 and 5 are associated with the electrolyzer 2, and the anode risers assemblies 8 and 9 are associated with the electrolyzer 1. Anode risers 6, 7, 10 and 11 are positioned between the electrolyzers 2 and 3. The anode risers 6 and 7 are associated with the electrolyzer 2, and the anode risers 10 and 11 are associated with the electrolyzer 3 as schematically shown in the drawing.

As can be seen from the drawing, in each of the spaces between next-adjacent electrolyzers, all four anode risers are positioned in the same vertical plane. Two anode risers are associated with one electrolyzer, while the other are associated with the other electrolyzer. The planes 20 and 22 of the anode risers 4, 5, 8 and 9, and 6, 7, 10 and 11, respectively, are schematically shown in the FIGURE. Thus, each of the anode risers 4, 5, 8 and 9 is located substantially at the same lateral distances from the parallel extending facing walls of the electrolyzers 1 and 2. In the same manner, the anode risers 6, 7, 10 and 11 are located in the same vertical plane. Each of the anode risers is the same respective lateral distance from the lateral facing walls of the next-adjacent electrolyzers as are the other ones of the anode risers. As seen in the FIGURE, the vertical plane containing the anode risers in each case is preferably equidistant from the facing walls of the electrolyzers.

The arrangement of the anode risers in the system of the invention provides a uniform distribution of the magnetic field due to currents of equal intensity at either end of the electrolyzer. Furthermore, the arrangement of the anode risers permits reduction of the space between any pair of next-adjacent electrolyzers by 200 to 600 mm compared to a conventional arrangement of anode risers for a two-sided current supply system where, as hereinbefore mentioned, they are disposed in two vertical planes between the electrolyzers. This reduction of spaces between next-adjacent electrolyzers enables the total length of the row of electrolyzers in series to be shortened by 20 to 50 m.

What is claimed is:

1. A dual system of current supply buses for aluminum-producing electrolyzers arranged transversely in a row in spaced relation with each other, said system having a plurality of anode risers in each space between next-adjacent electrolyzers, anode systems and anode buses electrically connected to the anode risers for supplying current from said anode risers to said anode systems, at least two anode risers of one of a pair of next-adjacent electrolyzers being coplanarly positioned in the space between said next-adjacent electrolyzers, and at least two anode risers of the other of said pair of next-adjacent electrolyzers being positioned in said space between said next-adjacent electrolyzers in coplanar relation with the anode risers of said one of said next-adjacent electrolyzers.

2. A dual system of current supply buses for aluminum-producing electrolyzers as claimed in claim 1, wherein next-adjacent electrolyzers have substantially vertical lateral walls facing each other and bordering the space between said next-adjacent electrolyzers and said anode risers are positioned in a plane parallel to and spaced from said walls.

3. A dual system of current supply buses for aluminum-producing electrolyzers as claimed in claim 1, wherein the anode risers of said one of said next-adjacent electrolyzers are spaced from each other and the anode risers of said other of said next-adjacent electrolyzers are positioned between the anode risers of said one of said next-adjacent electrolyzers in spaced relation with each other and with said anode risers of said one of said next-adjacent electrolyzers.

4. A dual system of current supply buses for aluminum-producing electrolyzers as claimed in claim 2, wherein said plane is equidistant from said walls.

* * * * *